United States Patent [19]

Estes

[11] Patent Number: 4,510,883

[45] Date of Patent: Apr. 16, 1985

[54] APPARATUS FOR DISTRIBUTING POWDERED MATERIAL

[75] Inventor: Donald C. Estes, Winchester, Ky.

[73] Assignee: Speedco, Incorporated, Lexington, Ky.

[21] Appl. No.: 567,652

[22] Filed: Jan. 3, 1984 (Under 37 CFR 1.47)

[51] Int. Cl.[3] ..... B05B 1/02

[52] U.S. Cl. ..... 118/305; 118/308; 118/317; 239/662; 239/672; 239/673; 239/677

[58] Field of Search ..... 118/305, 308, 317; 239/662, 672, 673, 677

[56] References Cited

U.S. PATENT DOCUMENTS 2,813,722 11/1957 Pawela ..... 239/672
3,019,025 1/1962 Young ..... 239/673
3,331,607 7/1967 Sammarco ..... 239/672 X
3,533,375 10/1970 McConnell ..... 118/308

FOREIGN PATENT DOCUMENTS 2098443 11/1982 United Kingdom ..... 239/672

*Primary Examiner*—Shrive P. Beck
*Attorney, Agent, or Firm*—Frost & Jacobs

[57] ABSTRACT

Apparatus and method for distributing powdered material uniformly in a generally vertical plane through an arc of about 180°, having particular utility for rock dusting underground coal mine tunnels. A pair of rotatable impeller means discharge entrained powdered material through a pair of housings each having oppositely disposed arcuate openings subtending an arc of about 120°. Generally vertical panels on each side of the impellers guide the discharged material.

21 Claims, 9 Drawing Figures

APPARATUS FOR DISTRIBUTING POWDERED MATERIAL

BACKGROUND OF THE INVENTION

This invention relates to apparatus and a method for uniformly discharging powdered material in a generally vertical plane throughout an arc of about 180°. Although not so limited, the apparatus has particular utility in distributing powdered rock, such as limestone, over the ceilings, ribs (walls) and floors of underground coal mines.

The practice of "rock dusting" underground coal mines is for the purpose of coating coal dust and depositing the coated particles on mine floors, thereby decreasing the potential for explosion created by coal dust entrained in mine atmospheres and decreasing the likelihood of inhalation of coal dust by mine workers.

Devices for rock dusting of mines are in use at the present time, which utilize a single-bladed rotating impeller which discharges powdered rock upwardly and laterally. To the best of applicant's knowledge such devices are incapable of distributing rock dust in a uniform pattern and require servicing by several workers during operation. There is therefore a need for a reliable rock dust distributor which can discharge powdered material uniformly over the ceilings, ribs and floors of underground mines and which requires only one operator.

SUMMARY OF THE INVENTION

It is an object of the invention to provide apparatus and a method for uniformly distributing powdered, free-flowing material, such as rock dust, over surrounding surfaces throughout an arc of about 180°, which requires a minimum of labor during operation. When used in an underground coal mine the apparatus of the invention is installed in a conventional mine scoop equipped with an hydraulic system, such a scoop being a low-slung wheeled vehicle with a generally horizontal blade on the front thereof.

According to the invention there is provided apparatus for discharging powdered mineral material in a generally vertical pattern, including a hopper for a supply of powdered mineral material, conveyor means in the base of said hopper, means for entraining said material in a stream of air, rotatable impeller means for discharging the entrained material, means for rotating said impeller means, the impeller means comprising a pair of contra-rotating, side-by-side blade assemblies, each blade assembly having a plurality of blades each inclined rearwardly from a radius of the axis relative to the direction of rotation, the tip of each blade being bent forwardly relative to the direction of rotation, a cylindrical housing surrounding each said blade assembly with clearance around a major portion of the circumference of each said blade assembly, said housing projecting beyond said blade assembly toward said conveyor means, an arcuate opening in each said housing subtending an arc of about 120°, said arcuate openings being oppositely disposed with respect to one another and having an upper edge positioned about 30° before top dead center with respect to the direction of rotation of each said blade assembly, and a substantially planar, generally vertical panel on which said blade assemblies and housings are mounted so as to project toward said hopper and conveyor means, said panel extending outwardly in all directions beyond said blade assemblies and housings, whereby said entrained material is impelled outwardly by said rotating blade assemblies and distributed uniformly by said arcuate openings and said panel in a generally vertical plane laterally and upwardly throughout an arc of about 180°.

The method of applying powdered mineral material to the ceiling and walls of a substantially horizontal mine tunnel, in accordance with the invention, comprises supplying powdered mineral material to a source of air currents in which said material is entrained, rotating the entrained material rapidly, discharging said material upwardly and laterally by centrifugal force in a generally vertical plane at a velocity sufficient to impinge upon and cling to said ceiling and walls, and guiding said discharged material whereby to form a uniform pattern of distribution throughout an arc of about 180°.

DETAILED DESCRIPTION

Figure 3:
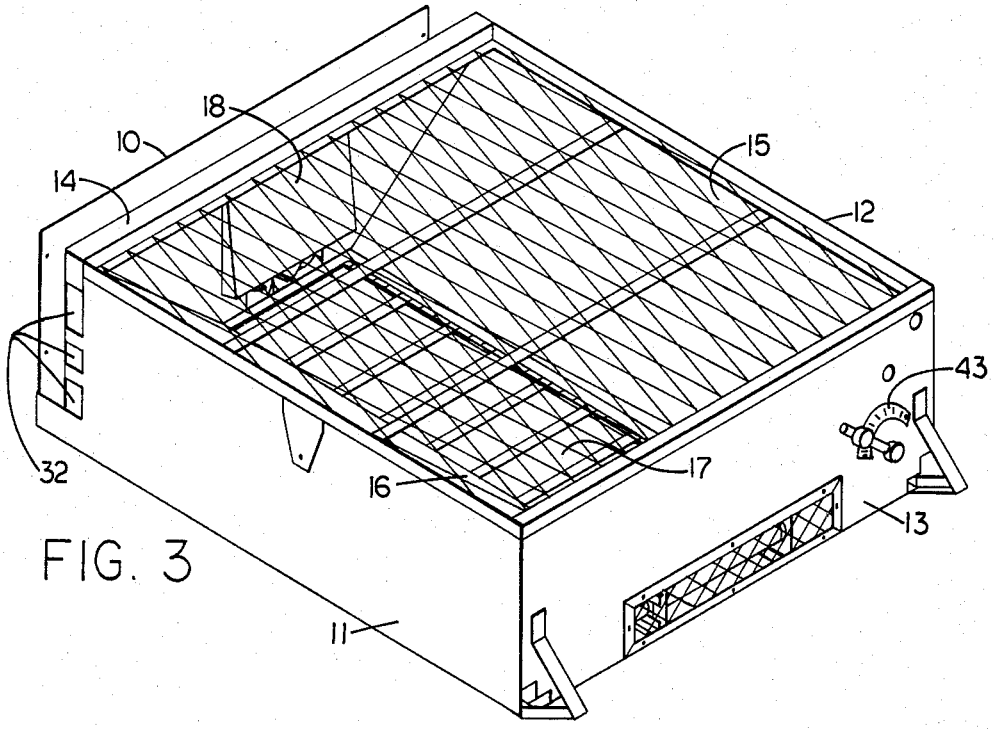
FIG. 3 is a perspective view of apparatus embodying the invention.
Figure 4:
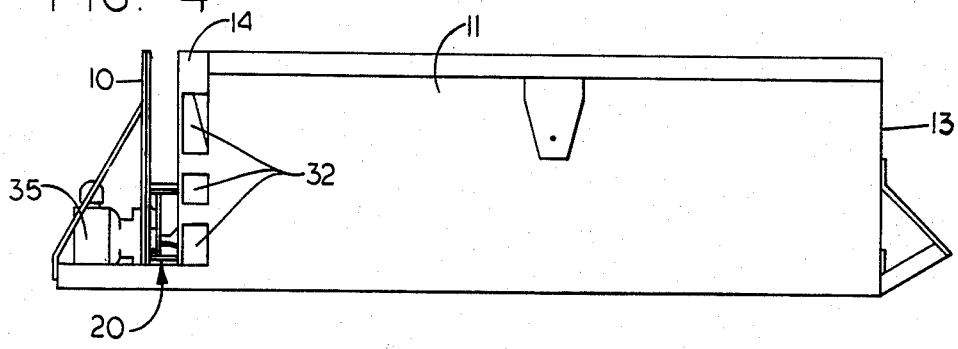
FIG. 4 is a side plan view of apparatus embodying the invention.
Figure 5:
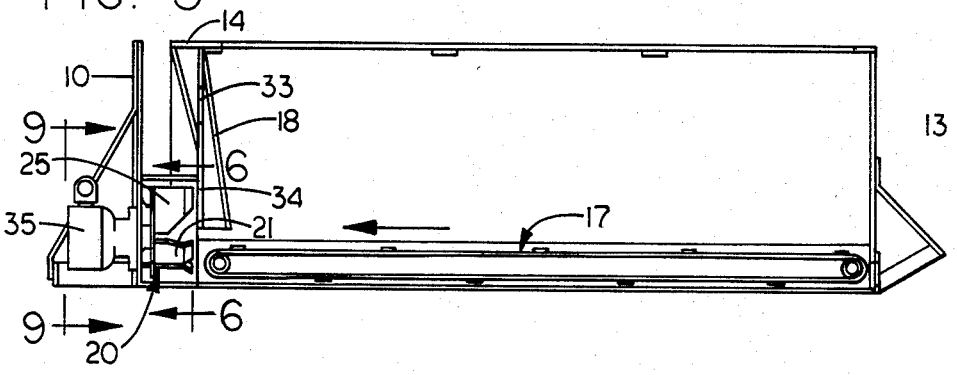
FIG. 5 is a vertical sectional view of the apparatus of FIG. 4.

Referring first to FIGS. 3, 4 and 5 of the drawings, apparatus in accordance with the invention comprises a substantially planar, generally vertical panel 10, side walls 11 and 12 and an end wall 13. A bulkhead 14 is provided in spaced relation to the panel 10 and substantially parallel thereto, the bulkhead, side walls and end wall forming a substantially rectangular enclosure with an open top. The interior of the enclosure is provided with downwardly and inwardly inclined side walls 15 and 16, as shown in FIG. 3, forming a hopper for powdered mineral material. In the base of the hopper conventional bar-type conveyor means is provided as indicated generally at 17. As shown in FIG. 5 conveyor means 17 extends substantially the length of the hopper from end wall 13 to bulkhead 14. The upper flight of conveyor means 17 advances material toward bulkhead 14.

Bulkhead 14 is further provided with a downwardly inclined enclosure 18 on the interior surface thereof with an open passage in the lowermost end thereof positioned above the end of conveyor means 17, through which air passes which entrains the powdered mineral material. The means for admission of air to enclosure 18 will be described hereinafter.

Figure 6:
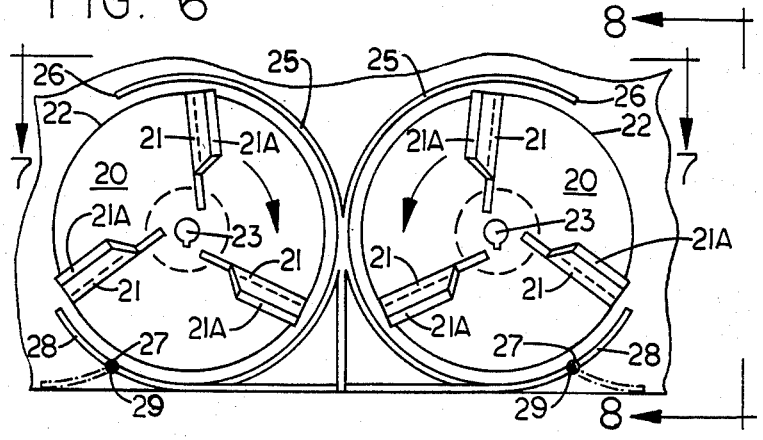
FIG. 6 is a sectional view taken along the line 6—6 of FIG. 5.

Referring to FIGS. 5 through 8, impeller means are indicated generally at 20. These impeller means are mounted on panel 10 and comprise a pair of contra-rotating blade assemblies in side-by-side arrangement. Each blade assembly includes a plurality of blades 21, the tip 21*a* of each blade being bent forwardly, preferably at an angle of about 45°, relative to the direction of rotation. As shown in FIG. 6, the direction of rotation of the right hand blade assembly is counter-clockwise while the direction of rotation of the left hand blade assembly is clockwise. Each blade is inclined rearwardly from a radius of the axis of the blade assembly relative to the direction of rotation. Preferably the rearward inclination is about 6°. Each blade assembly further includes a flat circular plate 22 to which the blades 21 are secured as by welding or other conventional means, and an axle 23 extending rearwardly from the center of each circular plate 22 is keyed thereto for rotation by means described hereinafter.

Figure 7:
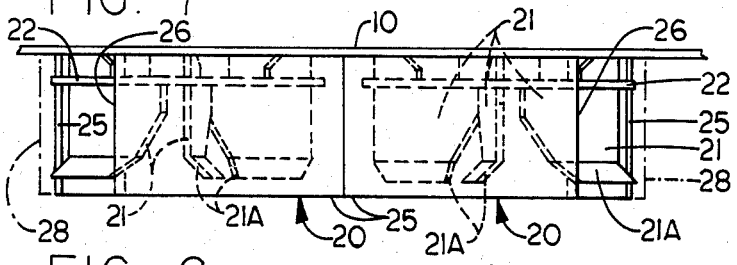
FIG. 7 is a sectional view taken along the line 7—7 of FIG. 6.
Figure 8:
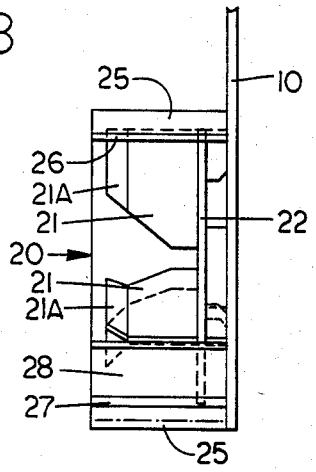
FIG. 8 is a sectional view taken along the line 8—8 of FIG. 6.

The impeller means further includes a cylindrical housing indicated at 25 surrounding each blade assembly with clearance around a major portion of the circumference thereof. As seen in FIGS. 7 and 8, each housing projects beyond the blade assembly toward the conveyor means, preferably about ¼ inch. The clearance between each cylindrical housing and the blade assembly is preferably about 3/16 inch. Each housing is provided with an arcuate opening subtending an arc of about 120°. As shown in FIG. 6 the arcuate openings are oppositely disposed with respect to one another, and the upper edge 26 of each arcuate opening is positioned about 30° before top dead center with respect to the direction of rotation of each said blade assembly. Thus, referring to FIG. 6, the edge 26 of the right hand cylindrical housing is approximately at the 1:00 o'clock position while the edge 26 of the left hand cylindrical housing is approximately at the 11:00 o'clock position.

The lower edge of each arcuate opening 27 is, as indicated above, about 120° removed from the edges 26, i.e. at about the 5:00 o'clock position in the right hand blade assembly of FIG. 6 and at about 7:00 o'clock in the left hand blade assembly of FIG. 6.

Figure 9:
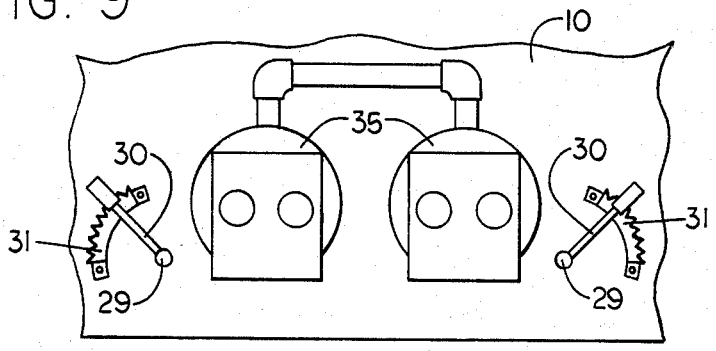
FIG. 9 is a fragmentary end view taken along the line 9—9 of FIG. 5.

Preferably baffle means indicated at 28 in FIG. 6 is provided, rotatably mounted on each housing 25 at the lower edge 27 thereof, the baffle means 28 being adjustable to vary the length of each arcuate opening, e.g. to decrease it by up to about 30°, thus providing an opening of about 90°, in order to control the pattern of discharge of powdered material. In FIG. 6, baffle means 28 is shown in broken lines in an open position and in solid lines in the closed position. Adjustment may be conveniently provided by the means shown in FIG. 9. Baffle means 28 is secured to a short shaft 29 at right angles thereto, the shaft 29 extending through the panel 10 with slight clearance therearound. A lever 30 is secured to the end of shaft 29 extending through panel 10 at right angles thereto, and a detent 31 is secured to the back of panel 10 to hold lever 30, and hence baffle means 28, in a desired position of adjustment.

Referring to FIGS. 3 and 4, means for admitting air is provided at 32 in bulkhead means 14. Air entering openings 32 on each side of bulkhead means 14 passes through an opening 33 shown in FIG. 5, then downwardly through enclosure 18 and through a passage 34 directly in front of the contra-rotating blade assemblies 20.

Figure 1:
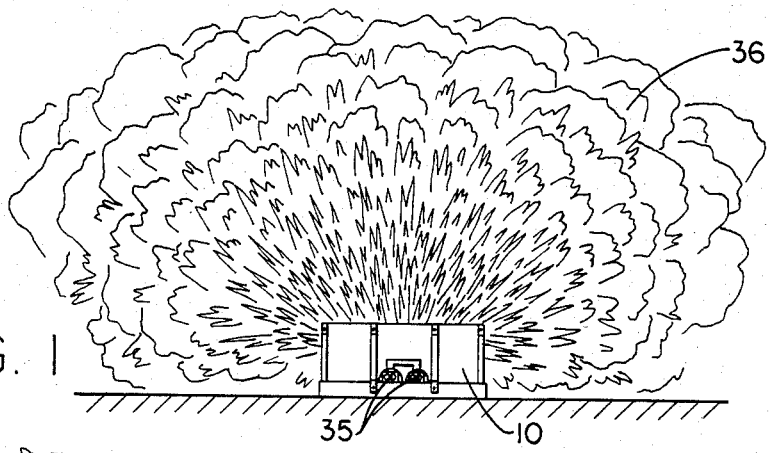
FIG. 1 is a diagrammatic illustration of apparatus of the invention showing the pattern of distribution in operation.
Figure 2:
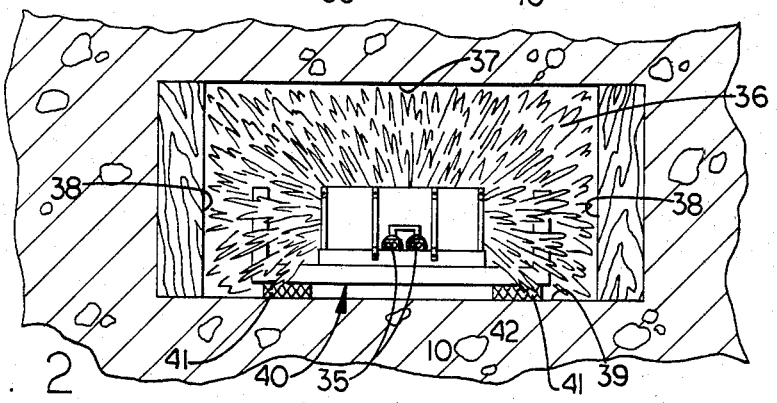
FIG. 2 is a diagrammatic illustration of apparatus embodying the invention in operation in an underground coal mine.

The blade assemblies 20 are rotated by a pair of hydraulically powered motors 35 shown in FIGS. 1, 2, 4, 5 and 9, each of which is connected to an axle 23. The hydraulic motors are of heavy duty gear type capable of imparting rotational speeds to the blade assemblies of up to 4000 rpm. It will be understood that rotation of the blade assemblies creates sub-atmospheric pressure in the regions immediately in front of them, thereby imparting substantial velocity to the air admitted through opening 34 which aids in entraining powdered solid material delivered by conveyor means 17. Entrained powdered material is thus delivered into each housing 25 and is subjected to the action of the rapidly rotating blade assemblies which impel the material outwardly through the arcuate openings in each cylindrical housing 25. The panel 10, bulkhead 14 and openings in the housings direct the powdered material uniformly in a generally vertical plane laterally and upwardly throughout an arc of about 180°. The distribution pattern is shown diagrammatically at 36 in FIGS. 1 and 2. In FIG. 1, the apparatus is shown in operation outdoors for test purposes. In FIG. 2, the apparatus is shown in its preferred use for rock dusting in an underground mine. In such an environment the discharge pattern 36 is distributed uniformly over the ceiling 37 and ribs 38 of a horizontal coal mine shaft or tunnel. The floor 39 is also coated by fall-out. The apparatus of the invention may be installed in a conventional mine scoop indicated generally at 40 having wheels 41 and a generally horizontal blade on the front thereof indicated at 42 on which the apparatus is positioned. Such a scoop is normally equipped with an hydraulic system which is connected to the motors 35 for rotating the blade assemblies 20, and the same hydraulic system is attached to a low speed, high torque motor (not shown) for driving the conveyor means 17. Preferably a control means indicated at 43 in FIG. 3 is provided to vary the speed of the conveyor means. On the other hand, it is contemplated that the blade assemblies 20 will be rotated at a constant speed regardless of the amount of powdered material delivered thereto.

The apparatus of the invention may be charged readily by dumping powdered material in the open top of the hopper, and its low profile facilitates loading and operation by only one workman. The only control needed is that indicated at 34 for variation in the speed of conveyor means 17, which in turn permits control over the amount of material discharged. Regardless of the amount discharged the pattern is distributed uniformly in a generally vertical plane between channel 10 and bulkhead means 14 throughout an arc of about 180°, as will be apparent from FIGS. 1 and 2.

In an exemplary embodiment each housing 25 has an 8 inch diameter, and the blades 21 and circular plate 22 have a diameter of 7⅜ inches. Each housing 25 extends 3¼ inches outwardly from panel 10, and the blades 21 are recessed within each housing 1/4 inch, as indicated above. The capacity of the hopper in this embodiment is about 1,000 pounds when using ground limestone. When distributing relatively dense, dry powdered mineral material it has been found that the clearance of 3/16 inch between the housing and blade assembly hold the entrained material on the blades until each blade reaches the opening in housing 25 and avoids an undesirable build-up of material in the bottom of each housing. The forwardly bent blade tips 21*a* ensure that the material is picked up from the interior of the housing and impelled outwardly by centrifugal force with considerable velocity. The rearwardly inclined configuration of each blade also contributes to effective discharge of the powdered material by increasing the resultant of rotational and centrifugal velocities.

It will be evident from the above description that the method of the invention includes entrainment of powdered material by introducing it into the region of subatmospheric pressure immediately in front of each blade assembly 20. When using powdered limestone, it is discharged at a velocity sufficient to travel at least about 25 feet laterally and at least about 8 feet vertically. This ensures coating of all exposed ceiling and wall surfaces of a typical underground coal mine tunnel. Tests have indicated that powdered limestone adheres strongly to such surfaces and even appears to be embedded therein.

I claim:

1. Apparatus for discharging powdered mineral material in a generally vertical pattern, including a hopper for a supply of powdered mineral material, conveyor means in the base of said hopper, means for entraining said material in a stream of air, rotatable impeller means for discharging the entrained material, means for rotating said impeller means, said impeller means comprising a pair of contra-rotating, side-by-side blade assemblies, each blade assembly having a plurality of blades each inclined rearwardly from a radius of the axis relative to the direction of rotation, the tip of each blade being bent forwardly relative to the direction of rotation, a cylindrical housing surrounding each said blade assembly with clearance around a major portion of the circumference of each said blade assembly, said housing projecting beyond said blade assembly toward said conveyor means, an arcuate opening in each said housing subtending an arc of about 120°, said arcuate openings being oppositely disposed with respect to one another and having an upper edge positioned about 30° before top dead center with respect to the direction of rotation of each said blade assembly, and a substantially planar, generally vertical panel on which said blade assemblies and housings are mounted so as to project toward said hopper and conveyor means, said panel extending outwardly in all directions beyond said blade assemblies and housings, whereby said entrained material is impelled outwardly by said rotating blade assemblies and distributed uniformly by said arcuate openings and said panel in a generally vertical plane laterally and upwardly throughout an arc of about 180°.

2. The apparatus claimed in claim 1, including baffle means rotatably mounted on each said cylindrical housing at the lower edge of said arcuate opening therein, said baffle means being adjustable to vary the length of said arcuate opening.

3. The apparatus claimed in claim 1, wherein said means for rotating said impeller means are hydraulically powered motors capable of imparting rotational speeds to said blade assemblies up to 4000 rpm.

4. The apparatus claimed in claim 1, including means for admitting air laterally of said conveyor means for entrainment of said powdered mineral material.

5. The apparatus claimed in claim 4, including bulkhead means forming an end of said hopper adjacent said blade assemblies and cylindrical housings, said bulkhead means having passages for said air admitted laterally and a passage for delivery of said powdered material from said conveyor means to said housings.

6. The apparatus claimed in claim 1, wherein each of said blades is inclined rearwardly about 6°.

7. The apparatus claimed in claim 6, wherein the tip of each blade is bent forwardly about 45° relative to the direction of rotation.

8. The apparatus claimed in claim 7, wherein each said blade assembly comprises a circular plate, an axle therethrough, and three of said blades secured to said plate and spaced equidistantly around said axle.

9. The apparatus claimed in claim 5, wherein said bulkhead means is substantially parallel to said panel, said blade assemblies and said housings being positioned therebetween.

10. The apparatus claimed in claim 1, wherein said housings project about ¼ inch beyond said blade assemblies.

11. The apparatus claimed in claim 1, wherein the clearance between said housings and the tips of said blades is about 3/16 inch.

12. The apparatus claimed in claim 1, including hydraulically powered motors for operating said conveyor means, and means for varying the speed of said conveyor means.

13. In apparatus for discharging powdered material in a generally vertical pattern, including a hopper for a supply of powdered material, conveyor means in the base of said hopper, and impeller means for discharging said material, the improvement wherein said impeller means comprises a pair of contra-rotating, side-by-side blade assemblies, each blade assembly having a plurality of blades each inclined rearwardly from a radius of the axis relative to the direction of rotation, the tip of each blade being bent forwardly relative to the direction of rotation, a cylindrical housing surrounding each said blade assembly with clearance around a major portion of the circumference of each said blade assembly, said housing projecting beyond said blade assembly toward said conveyor means, an arcuate opening in each said housing, said arcuate openings being oppositely disposed with respect to one another and having an upper edge positioned about 30° before top dead center with respect to the direction of rotation of each said blade assembly, means for entraining said material in a stream of air, means for rotating said blade assemblies in opposite directions, and a substantially planar, generally vertical panel on which said blade assemblies and housings are mounted so as to project toward said hopper and conveyor means, said panel extending outwardly in all directions beyond said blade assemblies and housings, whereby said entrained material is impelled outwardly by said rotating blade assemblies and distributed uniformly by said arcuate openings and said panel in a generally vertical plane laterally and upwardly throughout an arc of about 180°.

14. The improvement claimed in claim 13, including baffle means rotatably mounted on each said cylindrical housing at the lower edge of said arcuate opening therein, and means for adjusting said baffle means to vary the length of said arcuate opening.

15. The improvement claimed in claim 13, including means for admitting air laterally of said conveyor means for entrainment of said powdered mineral material.

16. The improvement claimed in claim 15, including bulkhead means forming an end of said hopper adjacent said blade assemblies and cylindrical housings, said bulkhead means having passages for said air admitted laterally and a passage for delivery of said powdered material from said conveyor means to said housings.

17. The improvement claimed in claim 13, wherein each of said blades is inclined rearwardly about 6°.

18. The improvement claimed in claim 17, wherein the tip of each blade is bent forwardly about 45° relative to the direction of rotation.

19. The improvement claimed in claim 18, wherein each said blade assembly comprises a circular plate, an axle therethrough, and three of said blades secured to said plate and spaced equidistantly around said axle.

20. The improvement claimed in claim 13, wherein said housings project about $\frac{1}{4}$ inch beyond said blade assemblies.

21. The improvement claimed in claim 13, wherein the clearance between said housings and the tips of said blades is about 3/16 inch.

* * * * *